United States Patent [19]

Hughes et al.

[11] 4,316,533

[45] Feb. 23, 1982

[54] CONTAINER DEPOSIT REFUND SYSTEM

[75] Inventors: Robert D. Hughes; James Brazell, both of Atlanta, Ga.

[73] Assignee: The Coca-Cola Company, Atlanta, Ga.

[21] Appl. No.: 127,036

[22] Filed: Mar. 4, 1980

[51] Int. Cl.[3] ..... G07F 7/06

[52] U.S. Cl. ..... 194/4 C; 194/1 E; 194/4 E; 209/528; 209/578; 209/587

[58] Field of Search ..... 194/4 R, 4 C, 4 D, 4 E, 194/1 E; 100/DIG. 2, 528; 209/578, 583, 587, 924, 524

[56] References Cited

U.S. PATENT DOCUMENTS

| | | | |
|---|---|---|---|
| 2,887,204 | 5/1959 | Giuliano | 194/4 R |
| 3,430,766 | 3/1969 | Stone | 209/587 X |
| 3,650,400 | 3/1972 | Warren et al. | 209/528 X |
| 3,661,258 | 5/1972 | Madalo et al. | 209/587 |
| 3,802,559 | 4/1974 | Luchetti | 209/583 |
| 4,248,334 | 2/1981 | Hanley et al. | 194/4 E X |

*Primary Examiner*—H. Grant Skaggs
*Assistant Examiner*—Edward M. Wacyra
*Attorney, Agent, or Firm*—Birch, Stewart, Kolasch & Birch

[57] ABSTRACT

A machine for refunding the deposit on empty containers such as bottles or cans for encouraging their return is disclosed. The machine includes an access door through which an empty container is introduced to an inspection station whereupon an inspection device determines if the empty container is marked with a proper identifying mark unique to that brand of container. The inspection device includes an ultraviolet light source which directs ultraviolet radiation onto an identifying mark on the container and causes fluorescent emmission of a narrow band of light. The radiation detection scheme of the present invention employs at least a pair of photodetectors, one which detects the very narrow band of radiation emitted from the fluorescent identifying mark, and the other which monitors whether or not any adjacent light bands are emitted from the object to a significant degree. The presence of adjacent wavelengths of radiation above a predetermined level would indicate that the container was not authentic and would preclude the refund of any money to the person presenting the incorrect container. If the container is determined to be authentic, then the refund is returned and the container is retained by the machine.

12 Claims, 5 Drawing Figures

CONTAINER DEPOSIT REFUND SYSTEM

BACKGROUND OF THE INVENTION

1. Field of the Invention

The present invention relates to a container deposit refund system for refunding the deposit already paid on cans and similar type containers. More particularly, the present invention relates to a system for refunding the deposit on containers only when they are determined to be authentic, thus preventing the act of counterfeiting.

2. Description of the Prior Art

In the past, deposit bottles have been used to distribute soft drinks and other beverages in order to assure the containers return. This was due to the fact that the container had a value which prevented the container from being disposed of after use. Because of the expense of these containers, reuse was required. With the advent of non-deposit bottles and cans this type of container has seen less use in recent years. The cost of these non-deposit bottles and cans was actually less than the cost of recycling deposit bottles.

With the recent emphasis on preserving the ecology of our country, it has become desirable to use more deposit beverage containers in order to prevent the pollution of the environment which occurs when these containers are disposed of. Litter has become an ever-increasing problem in our country, and as a result, the need has been felt to require beverage containers to be accompanied by a deposit refundable upon return of the container. This refunding requirement for bottles and cans has created an added burden for the distributors of these bottles and cans since the cans must be manually collected from customers and the deposits returned. Also, the retail distributor must store the returned cans awaiting their pick up by the wholesale distributor.

Various automatic can refund devices have existed in prior art, however, these devices have all suffered from ease of substituting the authentic can to be refunded with a less desirable counterfeit one. In order to make systems such as this functional, it is necessary to determine with reasonable certainty the difference between authentic containers which are to be collected for a refund and undersirable containers and counterfeits which are not to be collected.

SUMMARY OF THE INVENTION

Accordingly, it is a primary object of the present invention to provide a device whereby a refund may be made for a desired can or other item without the danger of refunding money on undesirable containers.

It is another object of the present invention to provide an automatic refund device which provides a refund in return for a container which may be stored therein for later return to the manufacturer and recycling.

It is further an object of the present invention to provide a container recycling device whereby a container will be accepted for a refund at any hour so that the recycling process may be made more convenient to thereby facilitate the recovery of a greater number of cans or other containers.

It is further the object of the present invention to provide a system for detecting a desired container to be accepted by the automatic refunding system the container including a coded identifying mark which is difficult to counterfeit and simple to positively identify.

These and other objects have been solved in the present invention by the discovery of a means for identifying the can to be recovered for deposit, and through the use of a simplified system for exchanging the container for a refund using the simplified method of positive identification. A device is provided whereby the operator inserts the can onto an elevator platform which is then manually raised within the elevator shaft. When the elevator platform is raised to its highest point, a switch turns on a shortwave ultraviolet radiation source.

The shortwave radiation excites a phosphorescent identifying mark on the container. The phosphorescent identifying mark radiates light at a characteristic wavelength and predetermined intensity. A first filter integrally mounted with a first photodetector passes the proper radiated wavelength while second and third filters integrally mounted within a second photodetector allow light at higher and lower wavelengths than the proper radiated wavelength to pass to the photodetector. Thus, the first photodetector detects the level of light radiated by an authentic identifying mark while the second photodetector detects the presence or absence of light at higher or lower wavelengths. If the second photodetector detects a level of light greater than a predetermined level the container is determined to be counterfeit. The outputs of these photodetectors are processed by special electronics to determine if the container is authentic or not. When the authenticity of the container has been determined, a solenoid is activated which pushes the container through a door within a disposal tube which channels the container into either a compactor or container bin in the bottom of the device. Simultaneous to the collection of the container, a signal is sent to the change return box which returns an amount equal to the deposit originally paid on the container. Thus, the container has been recovered for recycling and the deposit returned to the operator. The detection system assures that non-authentic containers will not be accepted for refund.

BRIEF DESCRIPTION OF THE DRAWINGS

The objects of the present invention and the attendant advantages thereof will become more readily apparent by reference to the following drawings wherein.

DETAILED DESCRIPTION OF PREFERRED EMBODIMENTS

Figure 1:
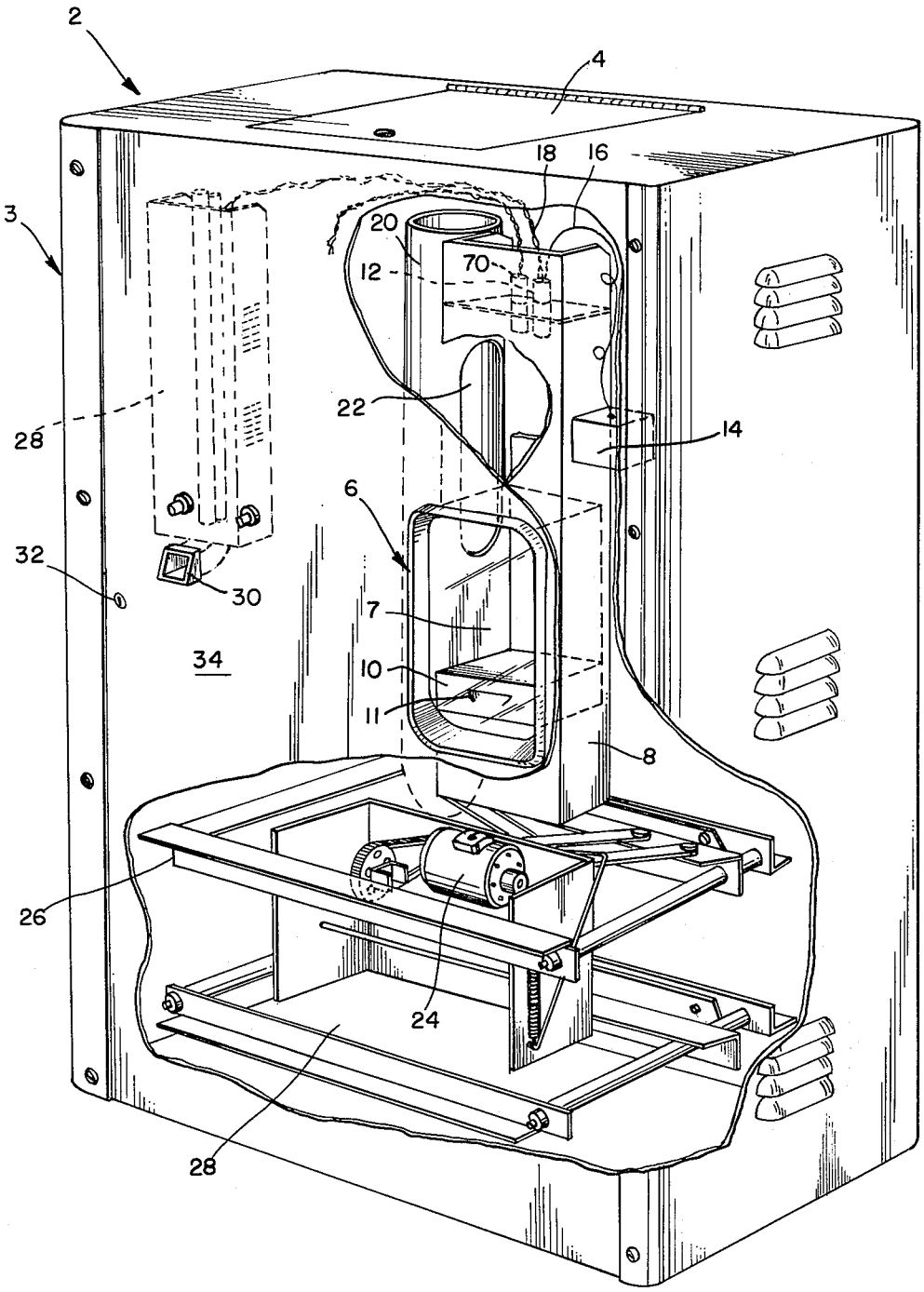
FIG. 1 is a perspective view illustrating the container refund device for the present invention.

Referring in detail to FIG. 1, there is illustrated a container deposit return device 2 for returning a deposit to the user of a container. The container deposit return device 2 includes a housing 3 which contains all the necessary elements of the present invention. An access door 4 is provided on the top of housing 3 so that service operations may be performed on the contents of the container deposit refund device 2.

An opening 6 is disposed on the front of housing 3 so that the user of the device may place a container on the elevator platform 10 so that it may be examined by the device. Elevator shaft 8 is provided so that elevator platform 10 may be slid up the elevator shaft 8 in order to allow the sensor 12 to sense the existence of a flourescent mark. Ultraviolet light source 70 applies light to the flourescent mark to cause the mark to omit light of a predetermined wavelength. Sensor 12 senses the presence of the flourescent mark on the top of the container to be sensed as well as the absence of other non-authentic marks in a manner which will be explained hereinafter. If the detector 12 senses that the container is authentic, then solenoid 14 will be energized through line 16 and the container will be ejected through the opening 22 in container chute 20. Solenoid 14 physically pushes the container to be recovered through the opening 22 in container chute 20. The container then falls through container chute 20 into either a bin disposed within the bottom section of housing 3, or a container compactor 24 mounted on a frame 26 disposed in the bottom of the housing 3. Container compactor 24 compresses the containers that have been recovered and they fill bin 28 within the compactor.

When the sensor 12 senses the existence of an authentic container a signal is also transmitted through line 18 to the coin return assembly 28 which is of a type well known in the art. Coin return 28 dispenses change to the user which corresponds to the amount of the deposit originally paid on the container. The housing 3 of the container deposit refund device 2 has an access door 34 on the front of the housing 3 which is secured by lock 32.

Figure 2:
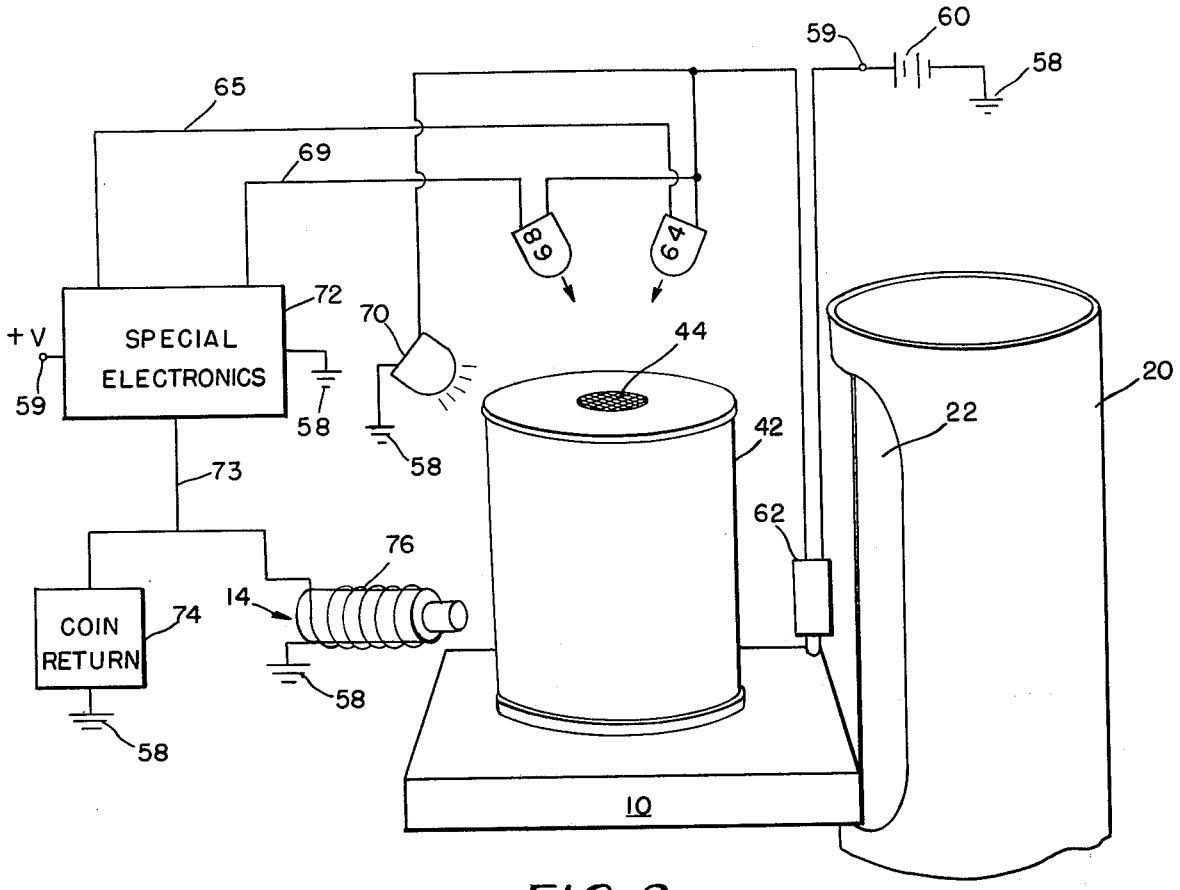
FIG. 2 is a diagrammatic view of the circuitry used to control the container deposit return device of the present invention.

FIG. 2 shows a schematic diagram of the circuitry used in the detection and refund process. When the elevator platform 10 is manually raised by the user to the top of its travel, switch 62 senses the presence of the platform 10 and connects 9–30 volt DC source 60 to energize the circuitry of the present invention. The negative terminal of source 60 is connected to a grounded reference potential 58. The positive terminal of source 60 is connected to a shortwave ultraviolet light source 70 and to photodiodes 64, 68 through switch 62. While the first terminal of ultraviolet light source 70 is connected to switch 62, the other terminal is connected to ground 58. While one terminal of photodiodes 64, 68 is connected to the switch 62, the other terminals are connected to the inputs of special electronics box 72 via lines 65, 69. Special electronics box 72 is energized by a positive voltage terminal 59 and a ground terminal 58. Special electronics box 72 determines the authenticity of the beverage container by monitoring the input lines 65, 69 from photodiodes 64, 68. When the authenticity of a can is determined a voltage appears on line 73. Line 73 is connected to solenoid 76 and to coin return 74. A voltage on this line 73 energizes solenoid 76 to eject can 42 through opening 22 in container chute 20 and signals the coin return 74 to return the deposit for the container in the form of change.

Figure 3:
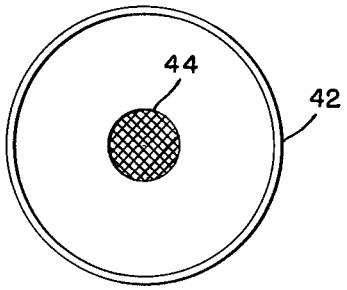
FIG. 3 is a top view of a container with the specially coded information imprinted thereon showing its relationship with the aperture plate used in detecting the specially coded pattern.

When ultraviolet light source 70 is energized, it excites the flourescent identifying mark, generally indicated as 44, to emit light of a particular wavelength. This fluorescent identifying mark 44 could comprise any pattern. In one preferred embodiment, the identifying mark 44 comprises a dot. FIG. 3 shows the location of this dot on the bottom of the can.

Figure 5:
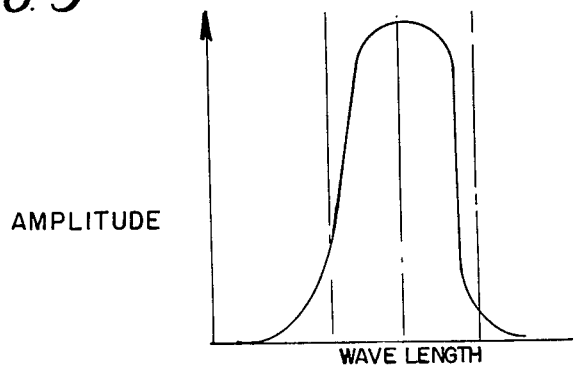
FIG. 5 is wavelength vs. Amplitude curve showing the spectral intensity of coded identifying mark in relation to the wavelengths detected by two or more photodiodes.

The relationship between the spectral intensity of the fluorescent identifying mark and the wavelengths detected by the two photodetectors are shown in FIG. 5. A first photodiode 64 detects light filtered by an integral filter which can pass only the wavelength of light reflected by an authentic identifying mark $\lambda_A$. The second photodetector 68 detects the presence of light filtered by its integral filter so that it contains only light at wavelengths less than $\lambda_{A-X}$ or greater than $\lambda_{A+X}$. Each of these wavelengths $\lambda_{A-X}$ or $\lambda_{A+X}$ has a predetermined difference in period X which places wavelengths $\lambda_{A-X}$ and $\lambda_{A+X}$ outside the spectral band of an authentic identifying mark. Thus, when an authentic identifying mark is presented to the detector 12, the signal on line 65 from the photodiode 64 will be high while the signal on line 69 from photodiode 68 will be low.

Sensor 64 is sensitive only to light above a predetermined minimum intensity slightly less than the intensity expected to be emitted from the identifying mark 44. Similarly, photodetector 68 is responsive to light of other wavelengths different from the proper radiated wavelength and above a predetermined level.

Figure 4:
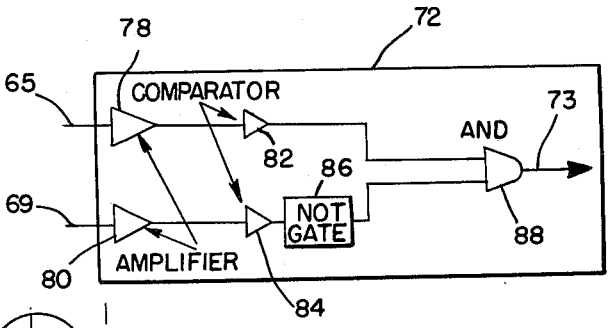
FIG. 4 is a logic diagram of the circuitry of the special electronics box 58 shown in FIG. 2.

A logic diagram of the special electronics box 72 is shown in FIG. 4. Line 65 from photodiode 64 is applied to a first input of AND gate 88 through amplifier 78 and comparator 82. Line 69 from photodiode 68 is applied to a second input of AND gate 88 through amplifier 80, comparator 84, and NOT gate 86. The output of AND gate 88 is the output 73 of special electronics box 72.

DESCRIPTION OF OPERATION

One can readily understand the operation of the container deposit return device of the present invention by reference to FIGS. 1 and 2. The user places the container from which he desires to obtain a refund on the elevator platform 10 by the use of opening 6 in the front panel of the housing 3. The operator then uses handle 11 to manually raise elevator platform 10 within elevator shaft 8 so that it is raised to the highest possible position. This closes switch 62 which activates the circuitry of the present invention including a shortwave ultraviolet light source 70 which bombards the top of the container 42 with ultraviolet light. This ultraviolet light excites the fluorescent identifying mark 44 on the top of container 42 and causes it to emit light of known wavelength $\lambda_A$. This coded light information is detected by photodiodes 64, 68. Filters are integrally disposed within photodiodes 64, 64. A first filter associated with a first photodiode 74 filters all wavelengths but the proper wavelength $\lambda_A$ to be reflected by an authentic identifying mark 43. This wavelength $\lambda_A$ is detected by a first photodiode 64. Second and third filters integrally disposed within a second photodiode 68 pass all wavelengths less than wavelength $\lambda_{A-X}$ corresponding to a light frequency higher than that emitted by an authentic identifying mark and all wavelengths greater than wavelength $\lambda_{A+X}$ corresponding to a light frequency lower that that emitted by an authentic identifying mark. Thus, the filters associated with second photodiode 68 filter out wavelengths within the spectral band expected to be emitted from fluorescent identifying mark 44. If an authentic identifying mark is presented to the detector, the output from photodiode 68 on line 69 will be low while the output of photodiode 64 on line 65 will be high. Any other combination of outputs from photodiodes 64, 68 will indicate that the identifying mark is not authentic. As a result, if a counterfeited identifying mark is presented to detector 12, the system will detect either the absence of light within the frequency expected to be emitted from an authentic identifying mark or the presence of light within the frequency range outside the expected frequency range.

Special electronics box 72 determines whether the output of photodiode 64 alone is high using a logic circuit that is well known. If the special electronics box 72 determines that the container 43 is authentic, then a signal is passed on to the coin return 72 which returns the user the deposit he has earlier paid on the container. Simultaneously, special electronics box 72 passes a signal to the coil 76 of solenoid 14 which causes the plunger of solenoid 14 to engage the container and push the container through the opening 22 of container chute 20.

Container chute 20 allows the container 42 to fall into a hopper in the bottom of the container deposit refund device or into a container masher 24 which crushes the containers and deposits them in a bin 28. The container masher 24 and the bin 28 are supported by a rack 26 which is attached to the frame of the housing 3. Thus the cans are stored for recovery by the serviceman and for easy recycling.

If the container is not determined to be authentic, the special electronics 72 will fail to drive the coil 76 of solenoid 14 and the container will not be pushed down container chute 20. Also, no signal will be passed to the coin return box 28 and therefore no change will be returned to the user. The non-authentic container then remains on the elevator platform 10 and when the user releases the handle 11 the elevator platform 10 returns to its lower position exposing the non-authentic container, allowing its removal.

It should be understood that the system described herein may be modified as would occur to one of ordinary skill in the art without departing from the scope of the present invention. For example, it would be well within the skill of one in the art to fit the container deposit return device of the present invention with an automatic ejector feature which would eject the can or container which was not detected to be authentic.

We claim:

1. An automatic refund device for refunding the deposit on deposit containers determined to be authentic, said containers having an identification means mounted thereon, comprising:

a housing containing an opening for receiving said containers therein;

detection means for detecting the authenticity of said containers by recognition of said identification means and for generating a refund signal in response thereto;

elevator means for moving said container from a first position adjacent said opening in said housing to a second position in close proximity to said detection means, said elevator means being selectively movable from the first to the second position;

container transport means for transferring said container from said elevator means for storage;

ejector means for moving said container from said elevator means to said container transport means in response to the refund signal from said detector means; and deposit refund means for returning the deposit in response to the refund signal from said detector means.

2. The automatic refund transport means of claim 1, wherein said container transport means comprises a chute for transferring said container away from said elevator means by the force of gravity.

3. The automatic refund device of claim 1, wherein said ejector means comprises a solenoid for pushing said container out of said elevator.

4. The automatic refund device of claim 1, wherein said detector means comprises:

first means for sensing the presence of at least a predetermined minimum intensity of radiation of a predetermined spectral frequency emitted from said identification means and producing a first signal in response thereto; and means for generating the refund signal in response to the presence of said first signal.

5. The automatic refund device of claim 4, wherein said detector means further comprises:

second means for sensing the presence of at least a predetermined minimum intensity of radiation of frequencies other than the predetermined frequency emitted from said identification means and for producing a second signal in response thereto; and wherein said means for generating generates a refund signal only in the absence of the second signal.

6. The automatic refund device of claims 1, 2, 3, 4 or 5 further comprising:

storage means for storing deposit containers delivered to it by said container transport means.

7. The automatic refund device of claims 1, 2, 3, 4 or 5 further comprising:

compactor means for reducing the volume of the deposit containers delivered to it by said container transport means and storing these containers therein.

8. A device for detecting the authenticity of an object including a radiation emitting identification means, the radiation emitted having a predetermined spectral frequency indicative of the authenticity of said object, comprising:

first means for sensing the presence of at least a predetermined minimum intensity of radiation of the predetermined spectral frequency emitted from said identification means and producing a first signal in response thereto;

second means for sensing the presence of at least a predetermined minimum intensity of radiation of frequencies other than the predetermined frequency emitted from said identification means and for producing a second signal in response thereto; and means for determining the authenticity of the object by detecting both the presence of said first signal and the absence of said second signal.

9. The device of claim 8, further comprising:

exciter means for exciting the identification means in order to cause the identification means to emit said radiation to be sensed.

10. The device of claim 9, wherein said exciter means comprises a radiant energy source; and wherein said identification means is fluorescent and said radiation emitted from said identification means is in the form of light waves.

11. A method of detecting the authenticity of an object including a radiation emitting identification means, the radiation emitted having a predetermined spectral frequency indicative of the authenticity of said object, including the steps of:

sensing the presence of at least a predetermined minimum intensity of radiation of the predetermined spectral frequency emitted from said identification means and producing a first signal in response thereto;

sensing the presence of at least a predetermined minimum intensity of radiation of frequencies other than the predetermined frequency emitted from said identification means and for producing a second signal in response thereto; and determining the authenticity of the object by detecting both the presence of said first signal and the absence of said second signal.

12. The method of claim 11 including the further step of:

exciting the identificaiton means in order to cause the identification means to emit said radiation to be sensed.

* * * * *